US005950259A

United States Patent [19]

Boggs

[11] Patent Number: 5,950,259

[45] Date of Patent: Sep. 14, 1999

[54] LOUNGE CHAIR HAVING INTEGRATED APERTURE COVER

[76] Inventor: Monte C. Boggs, 12975 Emerson, Lakewood, Ohio 44107

[21] Appl. No.: 09/167,800

[22] Filed: Oct. 7, 1998

Related U.S. Application Data

[60] Provisional application No. 60/061,466, Oct. 9, 1997.

[51] Int. Cl.[6] ..... A47C 17/64; A47C 17/66; A47C 7/62

[52] U.S. Cl. ..... 5/111; 5/725; 297/900

[58] Field of Search ..... 5/111, 725, 638, 5/110, 656; D6/361; 297/220, 221, 900, 219.1, 228.12, 188.08, 397, 403, 230.11, 230.13

[56] References Cited

U.S. PATENT DOCUMENTS

| | | | |
|---|---|---|---|
| D. 335,397 | 5/1993 | Fox | D6/361 |
| 3,318,632 | 5/1967 | Struble et al. | 297/220 |
| 3,897,102 | 7/1975 | LeMaire | 297/900 |
| 4,206,945 | 6/1980 | Kifferstein | 297/220 |
| 4,606,086 | 8/1986 | Rowland | 5/111 |
| 4,877,288 | 10/1989 | Lee | 297/220 |
| 4,941,222 | 7/1990 | Prager | 5/111 |
| 5,246,265 | 9/1993 | Nagan et al. | 297/54 |
| 5,297,850 | 3/1994 | Guleserian | 5/111 |
| 5,466,039 | 11/1995 | Umbrianna | 5/638 |
| 5,802,643 | 9/1998 | Sloot | 5/656 |
| 5,829,080 | 11/1998 | Robillard et al. | 5/656 |

*Primary Examiner*—Alexander Grosz
*Attorney, Agent, or Firm*—Fay, Sharpe, Beall, Fagan, Minnich & McKee, LLP

[57] ABSTRACT

A lounge chair is disclosed that includes an upper body support portion, an aperture extending through said upper body support portion, and a movable flap secured to the upper body support portion for selectively covering and uncovering the aperture. In particular, the flap can be repositioned to cover and uncover an aperture through a upper body support portion without having to get up out of the chair and without having to reposition the upper body support portion.

19 Claims, 6 Drawing Sheets

LOUNGE CHAIR HAVING INTEGRATED APERTURE COVER

CROSS REFERENCE TO RELATED APPLICATIONS

This application claims the benefit of U.S. Provisional Patent Application No. 60/061,466, filed Oct. 9, 1997.

BACKGROUND OF THE INVENTION

The present invention relates to the chair arts. It finds particular application in conjunction with lounge or deck chairs and will be described with particular reference thereto. However, it should be appreciated that the present invention may also find application in conjunction with other types of chairs and applications which require a flap for covering an aperture through a portion of the chair.

It is known to provide an aperture through an upper body support portion of a lounge chair in order for a person laying in a downwardly facing prone position to read through the aperture without obstructing the person's eyes, nose, and mouth. It is also known to make such an aperture adjustable by the use of a drawstring attached around the periphery of the opening wherein the ends of the drawstring are capable of being connected loosely or tightly to adjust the size of the aperture to the portion of the user's face that extends through the opening.

However, there is an inconvenience in that when a person desires to face upward in a prone position on such a lounge chair, the back of the person's head tends to fall through the aperture unless the person first adjusts the opening to sufficiently reduce the size thereof. Accordingly, every time the person rolls over, the draw strings must be untied, the size of the aperture adjusted, and the draw strings retied. In addition, the draw strings tend to hang downward from the lower surface of the upper body support portion of the lounge chair which typically requires that the user first get up off the lounge chair, reposition the upper body support portion to gain access to the draw strings, adjust the size of the aperture as described above, then return the upper body support portion to its original position.

In addition, with the aperture sufficiently reduced to support the back of the person's head, the material forming the upper body support portion tends to bunch up when drawn together which results in an uneven and thus uncomfortable surface upon which the person's head rests.

Accordingly, it has been considered desirable to develop a new and improved lounge chair which meets the above-stated needs and overcomes the foregoing difficulties and others while providing better and more advantageous results.

SUMMARY OF THE INVENTION

In accordance with one aspect of the present invention, a lounge chair is disclosed. The lounge chair includes an upper body support portion, an aperture extending through said upper body support portion, and a movable flap secured to the upper body support portion for selectively covering and uncovering the aperture.

In accordance with a second aspect of the present invention, a method for reconfiguring a chair is disclosed. The chair includes an upper body support portion, an aperture extending through the upper body support portion, and a movable flap secured to the upper body support portion, and the method including the steps of positioning the flap over the aperture, and repositioning the flap to expose the aperture thereby facilitating laying on the chair in a downwardly prone position.

One advantage of the present invention is the provision of a lounge chair having a flap that can be repositioned to cover and uncover an aperture through a upper body support portion without having to get up out of the chair and without having to reposition the upper body support portion.

Still further advantages of the present invention will become apparent to those of ordinary skill in the art upon reading and understanding the following detailed description of the preferred embodiments.

BRIEF DESCRIPTION OF THE DRAWINGS

The invention may take form in various components and arrangements of components, and in various steps and arrangements of steps. The drawings are only for purposes of illustrating a preferred embodiment(s) and are not to be construed as limiting the invention.

DETAILED DESCRIPTION OF THE PREFERRED EMBODIMENTS

Figure 1:
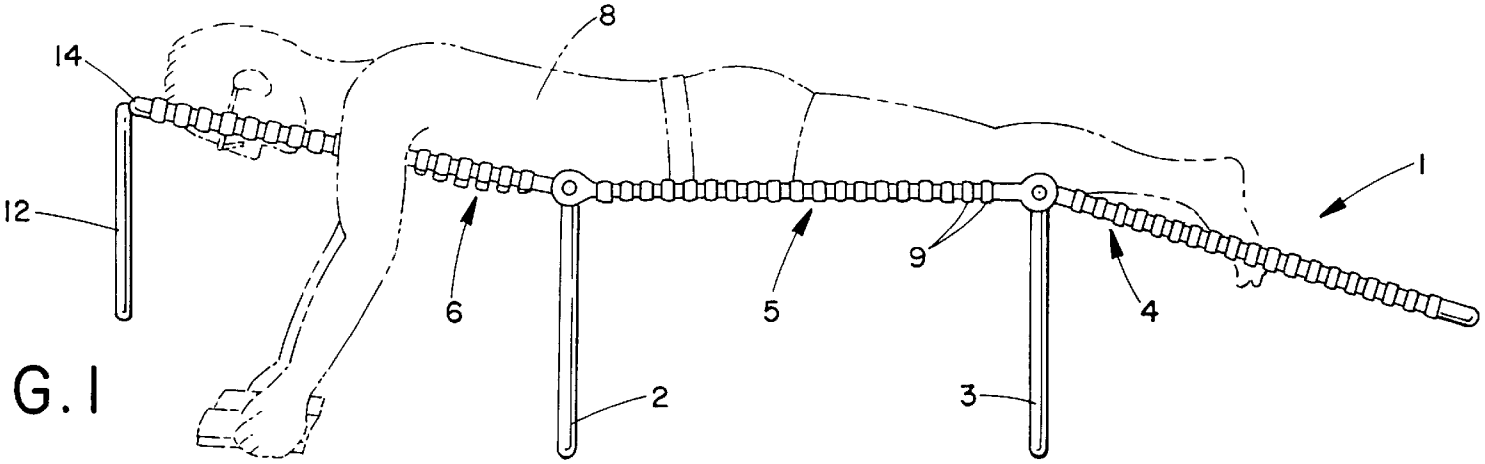
FIG. 1 is a side elevation view of a lounge chair in accordance with a first embodiment of the present invention.
Figure 2:
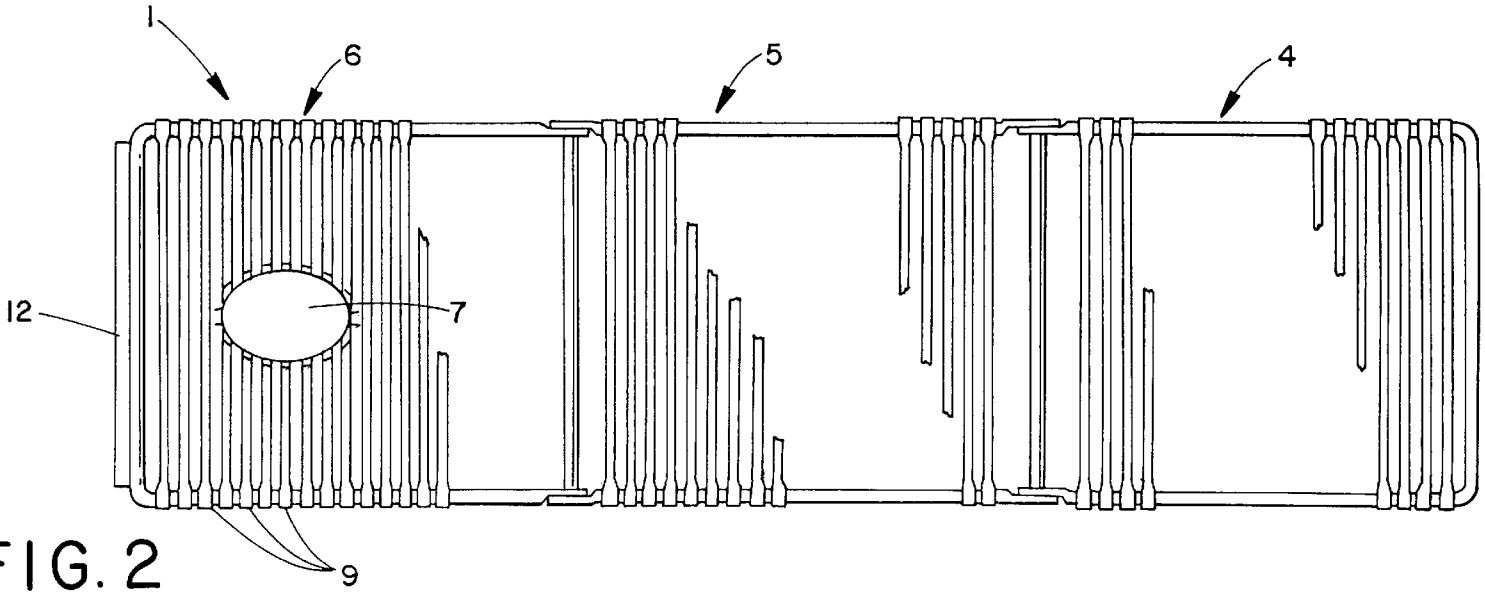
FIG. 2 is a top plan view of the lounge chair of FIG. 1.
Figure 3:
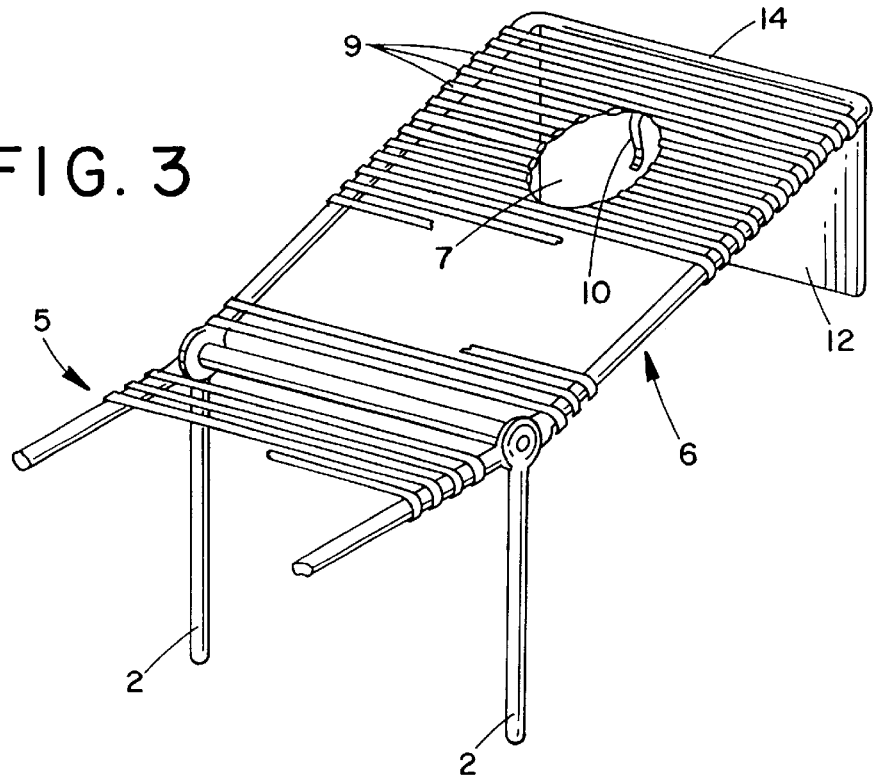
FIG. 3 is a perspective view partially broken away of an upper body support portion of the lounge chair of FIG. 1.

The invention may take form in various components and arrangements of components, and in various steps and arrangements of steps. The drawings are only for purposes of illustrating the preferred embodiments and are not to be construed as limiting the invention. Further, the advantages of the present invention will become apparent to those of ordinary skill in the art upon reading and understanding the following detailed description of the preferred embodiments.

With reference to FIGS. 1–4, an exemplary lounge chair 1 includes a central support frame 5. A lower body support frame 4 and a first leg 3 are each pivotally joined to the central support frame 5 at a first end thereof. Likewise, an upper body support frame 6 and a second leg 2 are pivotally joined to the central support frame 5 at a second end thereof.

As is known in the art, the upper and lower support frames can be secured to the central support frame 5 by a racheting mechanism which permits the respective support frames 4, 6 to extend from the central support frame 5 at any desired angle. In addition, the legs 2, 3 may be pivotally joined to the respective ends of the central support frame 5 with known ball and detent mechanisms which permit the legs to be locked in an extended position as shown in FIG. 1. Alternatively, the legs 2, 3 can remain fixed relative to the frame portions 4–6 in a downwardly extended position.

Figure 11:
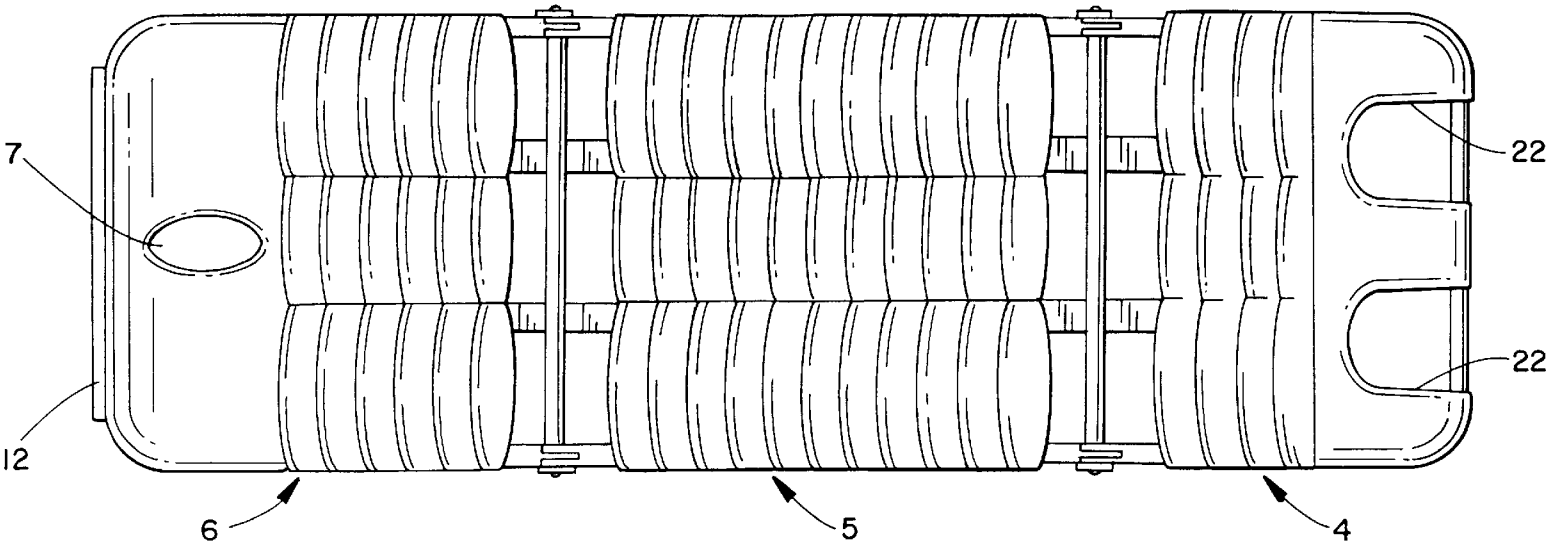
FIG. 11 is a top plan view of a lounge chair in accordance with a sixth embodiment of the present invention.

The frame portions 4–6 are each defined by spaced apart rungs 10 which may be formed by molding or extruding, etc. materials such as aluminum, plastic, resin, etc. A resilient support material 9 extends between each of the spaced-apart rungs 10 that define the frame portions 4, 5, 6. The material 9 may include sheet material, individual plastic tubes, webs of interlaced material, or any combination thereof (such as shown in FIG. 11), etc.

An aperture 7 extends through the support material 9 of at least the upper body support portion 6. The size of the aperture 7 may be fixed, or may be adjustable in a manner known in the art. For instance, the size of the aperture 7 can be adjusted by a drawstring 7*a* secured around the aperture. As shown in FIG. 1, the aperture permits a person 8 to lay face down in a substantially prone position so that the person's eyes, nose, and mouth extend through the aperture. The aperture 7 facilitates reading in the face down prone position.

Figure 4:
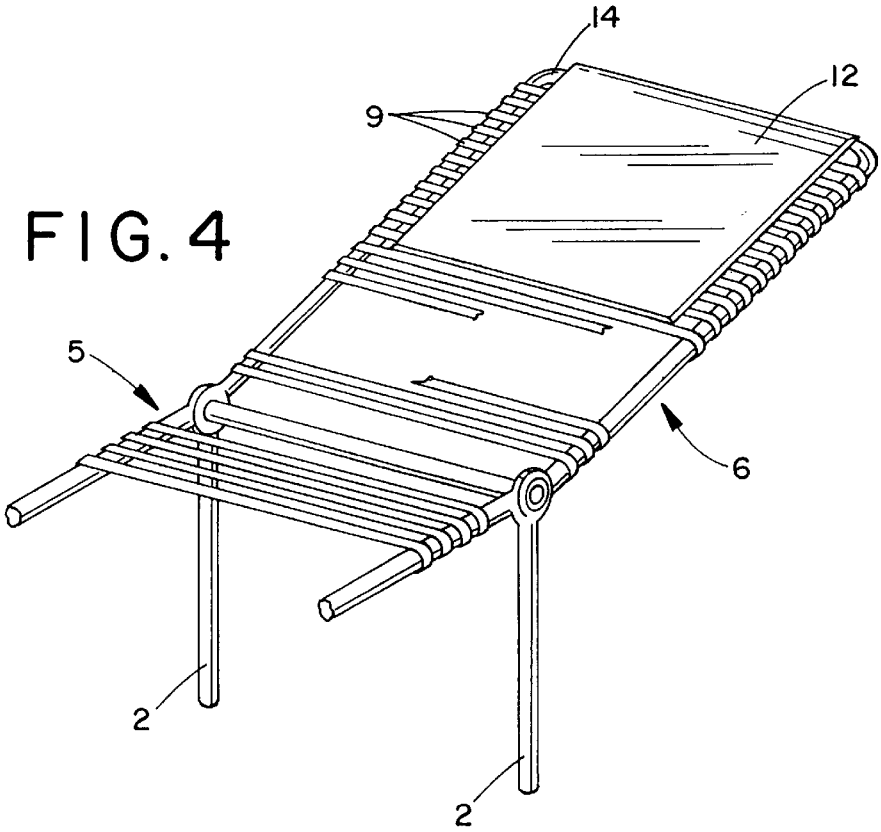
FIG. 4 is a perspective view partially broken away of the upper body support portion of the lounge chair of FIG. 1.

A flap 12 is pivotally secured to cross member 14 of the upper body support portion. Thus, as shown in FIG. 4, when a person desires to lay in an upwardly prone position on the lounge chair 1, the flap 12 can be pivoted upward and over the cross member 14 and onto the support material 9 of the upper body support portion 6 so as to cover the aperture 7. Likewise, when the person desires to lay in a downwardly prone position on the lounge chair, the flap 12 may be pivoted upward and back over the cross member 14, thus exposing the aperture 12. It should be appreciated that the aperture 7 may be quickly and easily covered and uncovered without having to adjust the size of the aperture 7, and without having to adjust the position of the upper body support portion 6 relative to the central support portion 5.

The flap 12 can be formed from the same material as the support material 9. The flap 12 can also be formed from a material different from the support material 9. The flap 12 can include an aluminum, plastic, or resin, etc. frame with spaced apart rungs. The flap 12 can be formed from any combination of materials such as cloth and foam which hang freely from the cross member 14.

Figure 5:
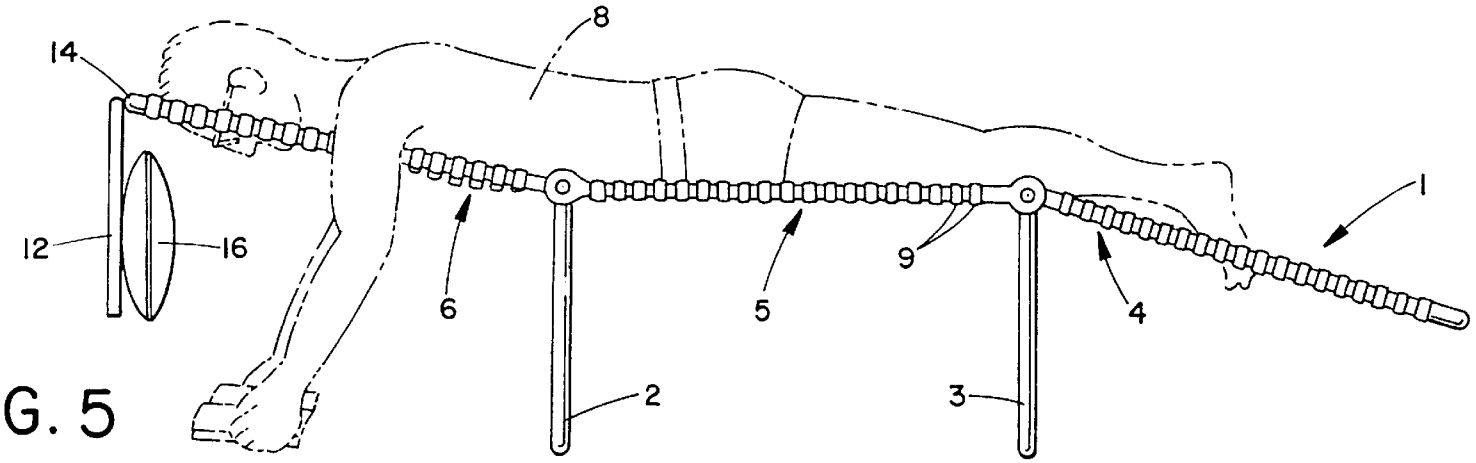
FIG. 5 is a side elevation view of a lounge chair in accordance with a second embodiment of the present invention.
Figure 6:
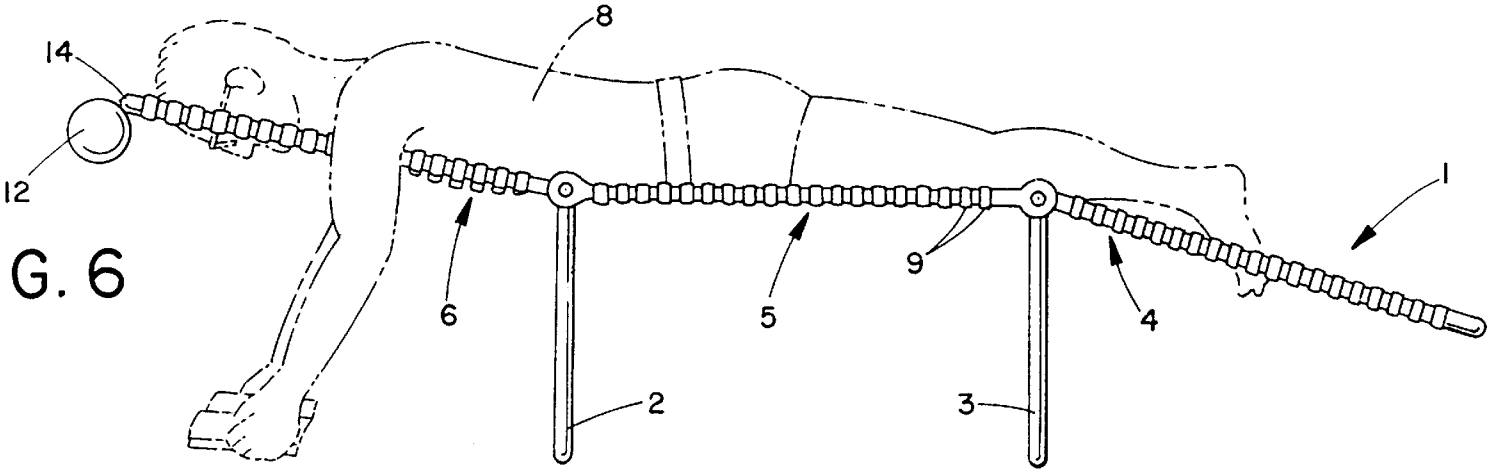
FIG. 6 is a side elevation view of a lounge chair in accordance with a third embodiment of the present invention.
Figure 7:
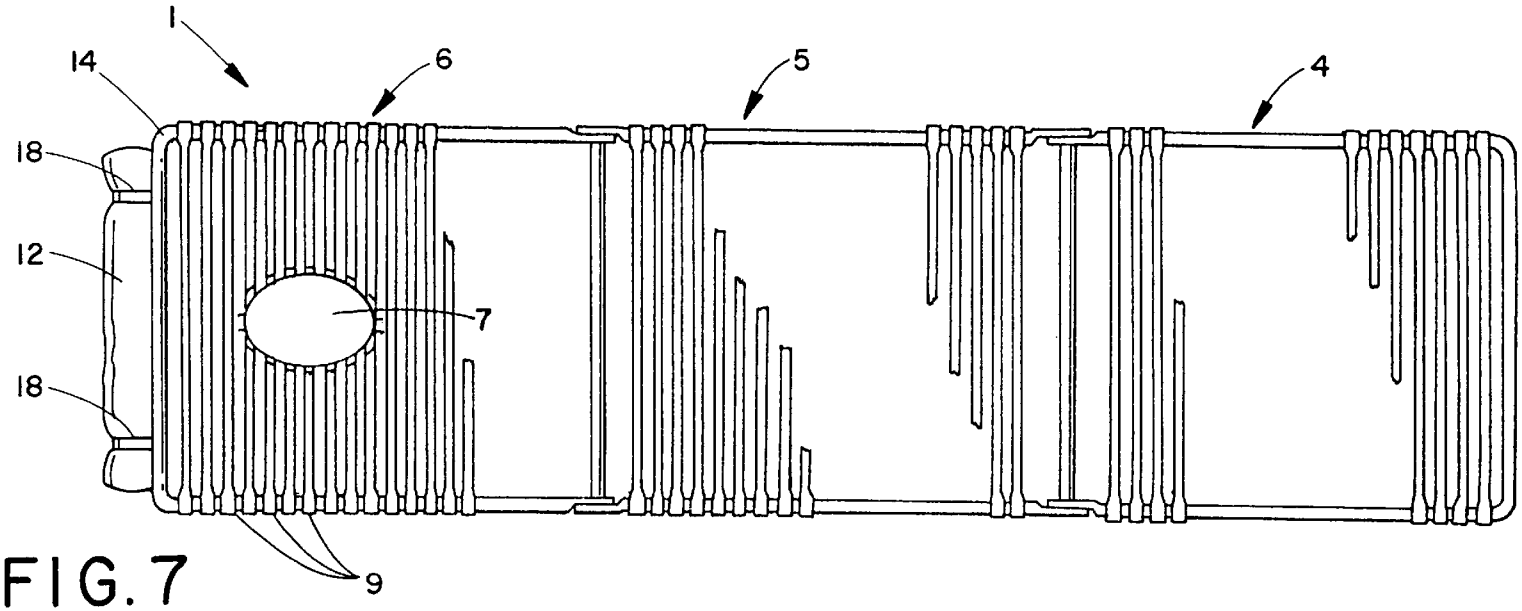
FIG. 7 is a top plan view of the lounge chair of FIG. 6.
Figure 8:
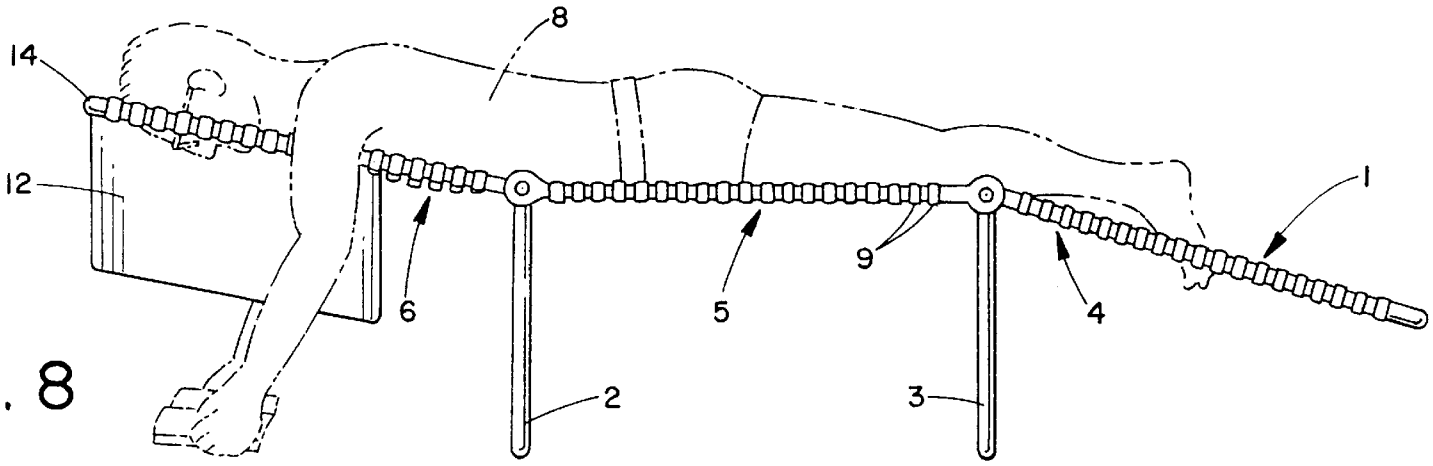
FIG. 8 is a side elevation view of a lounge chair in accordance with a fourth embodiment of the present invention.
Figure 9:
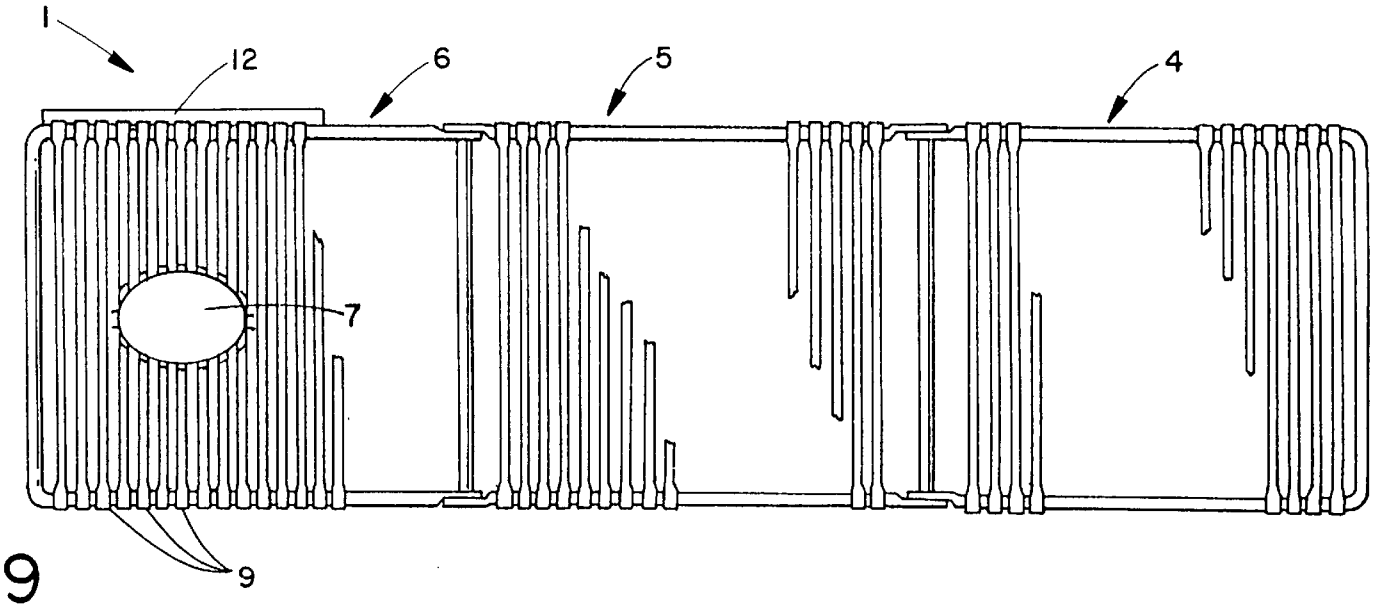
FIG. 9 is a top plan view of the lounge chair of FIG. 8.

As shown in FIG. 5, a pillow 16 can be removably or fixedly secured to the flap 12. As shown in FIGS. 6 and 7, the flap 12 can also be rolled or folded up when not in use and secured to the cross member with draw strings 18. As shown in FIGS. 8 and 9, the flap 12 can alternatively be secured to one of the rungs 10 defining the upper support frame.

Figure 10:
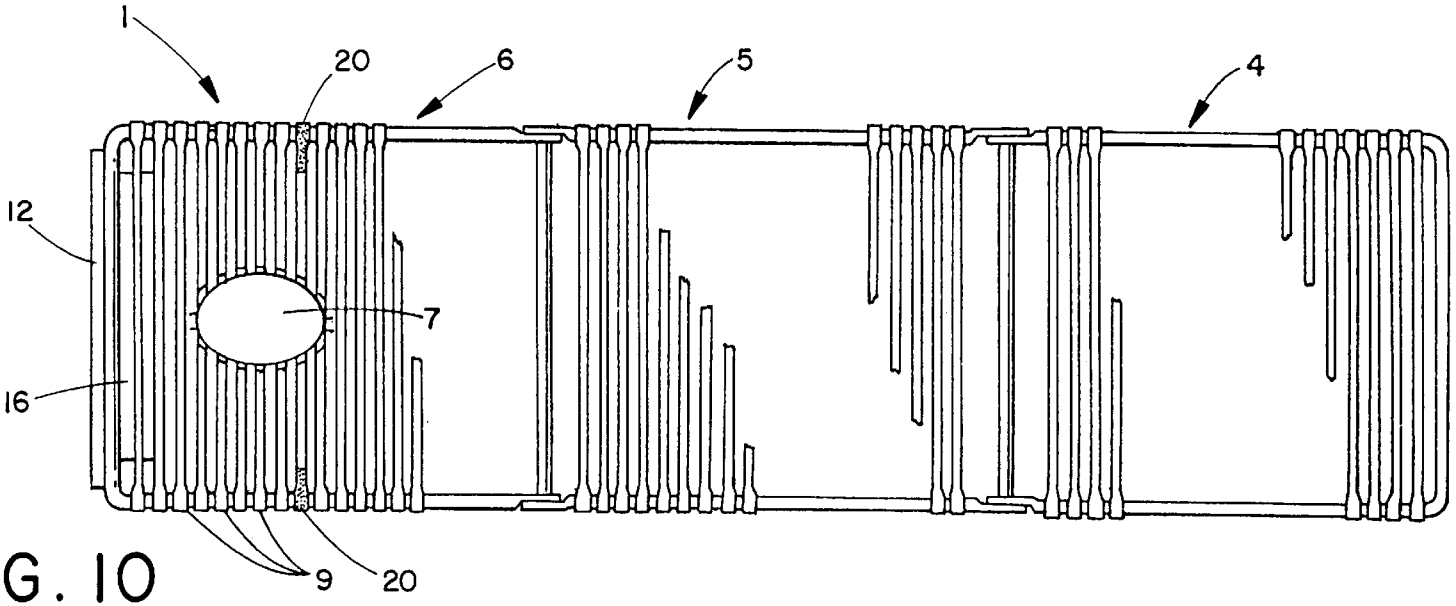
FIG. 10 is a top plan view of a lounge chair in accordance with a fifth embodiment of the present invention.

The flap 12 may be removably or fixedly secured to the cross member 14 or one of the rungs 10 in any known manner with any known fastening means such as with screws, Velcro, zippers, clips, ties, snaps, etc. Further, as shown in FIG. 4, the flap may simply rest on top of the upper body portion, or, as shown in FIG. 10, may be positively secured to the upper body portion 6 with, for example, one or more Velcro or other fastening means 20 joined to the support material 9, which fastening means 20 secure a free end of the flap to the upper body portion when the flap is resting on top of the support material 9.

It should be appreciated that the lounge chair 1 is exemplary only. The lounge chair 1 may also include arm rests extending from the central body portion 5 in a pivotal or fixed manner. Likewise, as shown in FIG. 11, the lower body support portion 4 may also include apertures 22 through the support material to permit a person's feet to extend at least partially through the support material. It is also contemplated that one or more additional flaps could be used to selectively cover the foot apertures 22.

Figure 12:
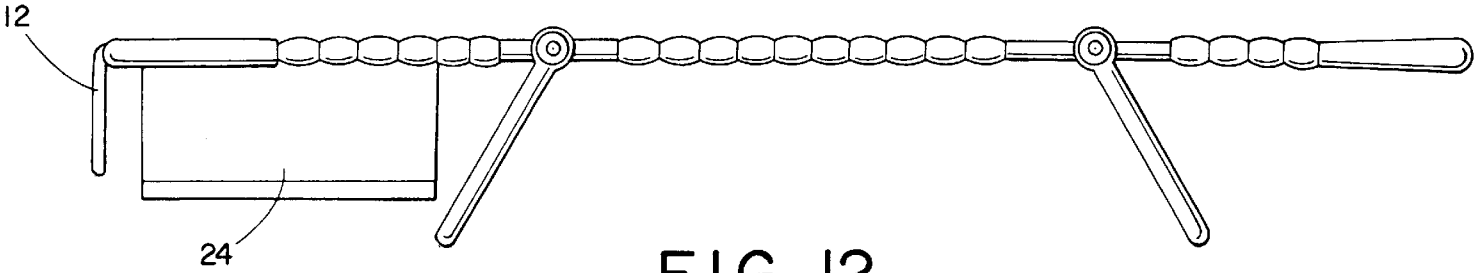
FIG. 12 is a side elevation view of a lounge chair in accordance with a seventh embodiment of the present invention.

Further, as shown in FIG. 12, a tray 24 may be suspended from the upper body support portion 6. The tray 24 extends below the aperture 7 and permits a person to place reading material (e.g. books, magazines, newspapers, glasses, etc.) on the tray. The material is then viewable through the aperture 7 when the person is in a downwardly facing prone position. The tray 24 prevents the reading material from contacting the potentially dirty, sandy, wet, etc. surface below the aperture 7.

The invention has been described with reference to the preferred embodiment(s). Obviously, modifications and alterations will occur to others upon reading and understanding the preceding detailed description. It is intended that the invention be construed as including all such modifications and alterations insofar as they come within the scope of the appended claims or the equivalents thereof.

Having thus described the preferred embodiment(s), the invention is now claimed to be:

1. A lounge chair comprising:

an upper body support portion;

an aperture extending through said upper body support portion; and a movable flap secured to the upper body support portion for selectively covering and uncovering the aperture, the flap being pivotally connected to the upper body support portion.

2. The chair of claim 1, wherein the upper body support portion includes a frame and support material spanning across the frame.

3. The chair of claim 2, wherein the frame includes a plurality of rungs and at least one cross member extending between the rungs.

4. The chair of claim 3, wherein the flap is secured to a rung.

5. The chair of claim 3, wherein the flap is secured to the cross member.

6. The chair of claim 2, wherein the aperture extends through the support material.

7. The chair of claim 6, further including means for fastening the flap to the support material when the flap is positioned to cover the aperture.

8. The chain of claim 1, further including a pillow secured to the flap.

9. The chair of claim 1, further including a tray secured to the upper body support portion below the aperture.

10. A method for reconfiguring a chair including an upper body support portion, an aperture extending through the upper body support portion, and a movable flap secured to the upper body support portion, the method including the steps of:

pivoting the flap to position the flap over the aperture; and repositioning the flap to expose the aperture thereby facilitating laying on the chair in a downwardly prone position.

11. The method of claim 10, wherein the upper body support portion includes a frame and support material spanning across the frame.

12. The method of claim 11, wherein the frame includes a plurality of rungs and at least one cross member extending between the rungs.

13. The method of claim 12, wherein the flap is secured to a rung.

14. The method of claim 12, wherein the flap is secured to the cross member.

15. The method of claim 11, wherein the aperture extends through the support material.

16. The method of claim 15, further including means for fastening the flap to the support material when the flap is positioned to cover the aperture.

17. The method of claim 10, further including a pillow secured to the flap.

18. The method of claim 10, further including a tray secured to the upper body support portion below the aperture.

19. A lounge chair comprising:

an upper body support portion;

an aperture extending through said upper body support portion; and a flexible flap secured to the upper body support portion for selectively covering and uncovering the aperture, the flap adapted to being unrolled and rolled-up to cover and uncover the aperture.

* * * * *